US005230480A

United States Patent [19]

Perry

[11] Patent Number: 5,230,480

[45] Date of Patent: Jul. 27, 1993

[54] FLEXIBLE MEMBER REELING DEVICE

[76] Inventor: Calvin W. Perry, 2220 College Avenue, Regina, Saskatchewan, Canada, S4T 1T9

[21] Appl. No.: 830,052

[22] Filed: Feb. 3, 1992

[51] Int. Cl.[5] ..... B65H 75/34

[52] U.S. Cl. ..... 242/85.1; 242/128

[58] Field of Search ..... 242/85.1, 85, 129, 128, 242/66.5 R

[56] References Cited

U.S. PATENT DOCUMENTS

| | | | |
|---|---|---|---|
| 2,412,396 | 12/1946 | Hanna | 242/96 X |
| 3,186,659 | 6/1965 | Arnold | 242/129 |
| 3,840,713 | 10/1974 | Carpentier | 242/129 X |
| 4,163,529 | 8/1979 | Krenzer et al. | 242/85.1 |
| 4,660,782 | 4/1987 | Hegemann | 242/96 X |
| 4,844,359 | 7/1989 | Kato | 242/85 X |
| 4,953,810 | 9/1990 | Stadig | 242/85 X |

*Primary Examiner*—Daniel M. Yasich

[57] ABSTRACT

A flexible member winding in and pay-out device. This device is commonly used with extension cords, dog leashes, towing cables and the like. There is provided a drum to receive a flexible member. A drum flange is attached to the drum for supporting the drum either on or off its base whereon the drum and flange are mounted. A cover means is rotatably mounted on and adjacently encircling an outer circumference of the drum and can form with the drum flange an endwise confinement for the flexible member wound on the drum. A hollow crank handle is pivotably attached to the cover means to internally guide the flexible member to or from the drum as relative rotation takes place therebetween.

14 Claims, 2 Drawing Sheets

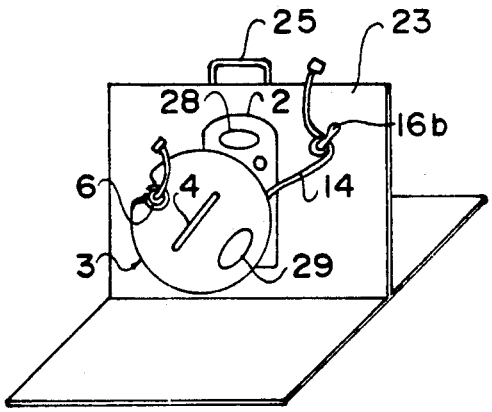
Fig 3
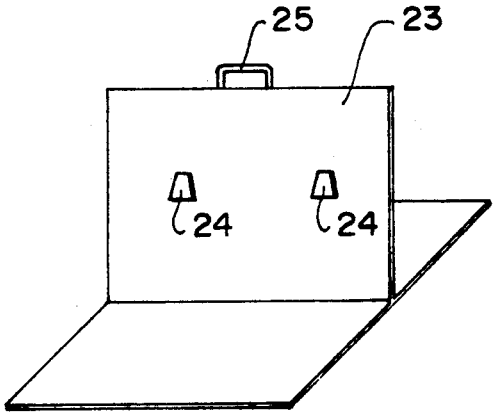
Fig 4
Fig 1
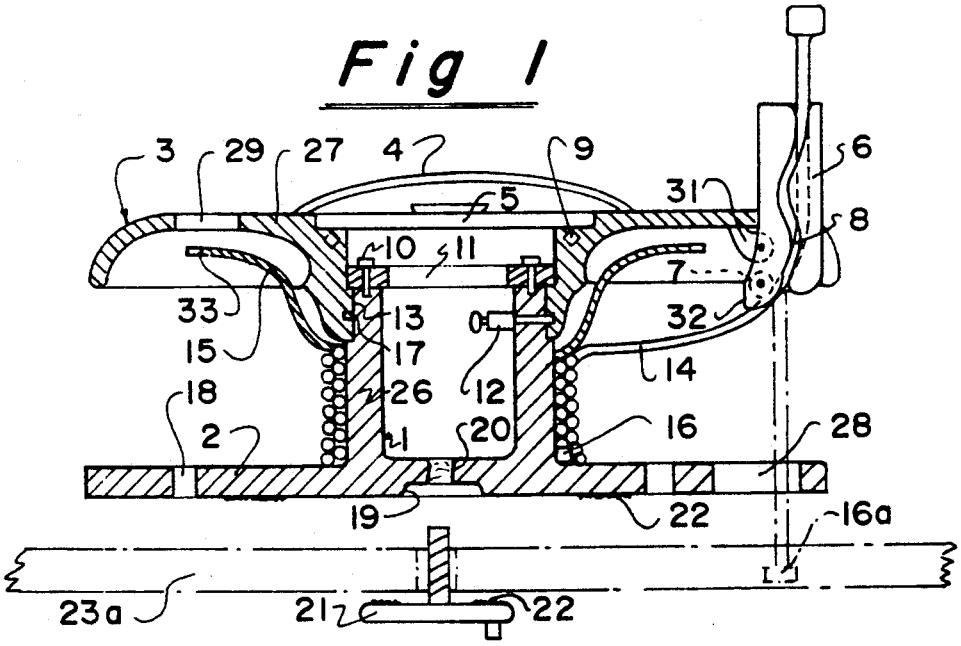
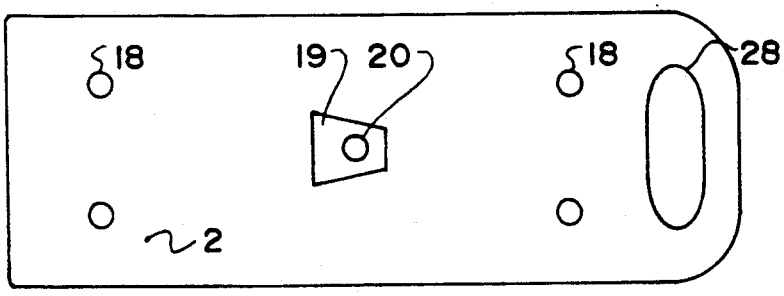
Fig 2

FLEXIBLE MEMBER REELING DEVICE

FIELD OF INVENTION

This invention relates to a winding or reeling device and more particularly to a device that can wind a flexible member on to a drum or facilitate a pay-out of the member from its wound up location on the drum.

BACKGROUND OF THE INVENTION

The art of winding and reeling dates back many years and as the need increased, the abundance of such devices increased. The winding of yarns in garment manufacture, the winding of wire in the electrical field and the winding of cord in the fishing art are only a few of the many examples. Applicants device developed from a basic requirement of winding and unwinding a flexible member in a controlled manner and which has many uses. A primary use being in the controlled reeling or unreeling of an electrical extension cord.

The closest prior art known to applicant which relates to the disclosed invention is found in U.S. Pat. Nos. 4,844,359, 4,660,782 and 2,412,396. U.S. Pat. No. 4,844,359 describes a reel for limited reeling of a flat cable for an electrical connection between a stationary member and a movable member. This reel is particularly characterized in that a cylindrical inner wall is provided outside said rotary cylinder in an eccentric relationship therewith. This device also indicates that the flat cable is reeled on or supplied from the moveable member. There is no indication that a hollow crank rotating about a drum will guide the flexible member on to and off of the drum.

U.S. Pat. No. 4,660,782 describes a portable reel that has a mounted non-rotatable spool that surrounds a central rotatable spindle. An elongate radial arm is corotatably attached to the spindle and a first end of the arm has rigidly attached thereto a manually graspable tubular guide for flexible conduit to be carried by the spool. Applicants device does not have a rotatable spindle located centrally of the spool, nor does it have a rotatable arm nor does it have the arm mounted on the spindle Applicants device has a cover that can properly act as an end confinement for the conduit while the cover means is rotatably mounted on and adjacently encircling an outer circumference of the drum or spool.

U.S. Pat. No. 2,412,396 describes a self-locking reel for a drying line. An annular drum or spool is rotatably mounted and axially slideable on a fixed spindle with apertures and an end confinement plate. It is the drum or spool that rotates on a spindle, the drum having projections that engage the apertures when tension is applied to the flexible conduit. Applicants device has no rotatable drum on a fixed spindle nor does it have projections on the drum engaging apertures in the spindle actuated by a tension in the conduit.

SUMMARY OF INVENTION

The present invention provides an apparatus for a controlled reeling in or pay-out of a flexible member. There is provided a base for mounting a drum to receive a flexible member. A drum flange is attached to said drum for supporting the drum on or off of the base. A cover means is rotatably mounted on and adjacently encircling an outer circumference of said drum, and can form with the drum flange an endwise confinement for the flexible member wound on the drum. A hollow crank handle is pivotably attached to said cover means to guide the flexible member to or from the drum as relative rotation takes place.

In view of the above it is therefore an object of the present invention to provide a device that will reel in, in an efficient and controlled manner, a flexible member such as an electrical extension cord.

It is another object of the above invention to provide a device that will permit a controlled pay-out of any flexible member that has been wound on the drum.

It is another object of the present invention to provide a reeling device adapted for rapid mounting or dismounting from its base.

It is a further object of the present invention to provide a base mounted reeling device wherein the base is equipped to receive an additional reeling device or other tools in the same manner.

It is a further object of the present invention to provide a flexible member retainer fixed to the drum to be engaged by a tooth of the pivoted crank handle on the cover to prevent relative rotation between the drum and cover means.

It is still another object of the present invention to provide a self support for the reeling device when manually mobile due to removal from the base.

It is yet another object of the present invention to provide a reeling device having a detent locking device to prevent unwanted relative rotation between the drum and the cover.

It is yet another object of the present invention to provide relocatable flexible member end fastening means.

It is yet another object of the present invention to provide a cover means pivotable crank handle having a tortuous longitudinal path slit opening to allow transverse entrance of the flexible member to the interior of the handle yet remain in the handle during pay-out.

These and other objects of the present invention will become readily apparent as the following description is read in conjunction with the accompanying drawings wherein like reference numerals indicate like elements throughout the several views.

DESCRIPTION OF THE DRAWINGS

FIG. 1 is a sectional view in elevation of the reeling device removed from its base.

FIG. 2 is an underside plan view of the drum flange in FIG. 1.

FIG. 3 is a perspective view of the instant invention mounted on its base.

FIG. 4 is a perspective view of the reverse side of the base with further mounting means.

DETAILED DESCRIPTION

Figure 5:
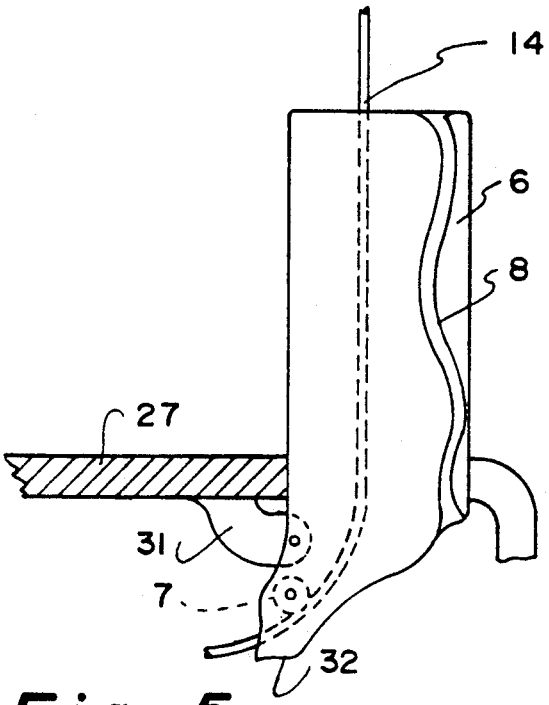
FIG. 5 is a detailed partial cross section in elevation of the pivotable crank handle.

Now referring to the drawings there is shown in FIG. 1 a reeling device having a drum means 1 comprising a drum body 26 and a drum flange 2. Rotatably mounted on and adjacently encircling an outer circumference of the drum body 26 is a cover means 3 comprising a cover body 27 and a cover plate 5 attached to the cover body 27 by cover plate fasteners 9. The cover body 27 is rotatably held in bearing contact with the drum body 26 in an outer circumferential recess 13 formed by the drum body 26 and a retainer ring 11 held to the drum body 26 by retainer ring fasteners 10. An alternate recess in the form of a groove in the outer circumference of the body 26 can adjacently and rotatably receive a flexible inner circumference of cover means 3, forced over an end of drum body 26. Cover handle 4 is mounted on cover means 3 to make the device more portable when removed from its base. A hollow crank handle 6 is pivotably mounted near the outer periphery of the cover body 27. This handle 6 has a slit in the form of a tortuous path 8 with outward tapers at each end and a roller 7 at the inner end to aid in the exit and entry of the flexible member 14. The tortuous path 8 permits entry of the flexible member 14 radially inwardly along the longitudinal axis of the handle 6 yet avoids disengagement when reeling in, or on pay-out. Handle 6 is supported by hinge means 31 and lock notch 30.

The toothed circular plate like retainer 15 is mounted on the drum body 26 and the retainer teeth 33 can be engaged by a tooth 32 on pivotable crank handle 6 when pivoted to prevent relative rotation between the drum body 26 and cover body 27. The retainer 15 when installed prevents any possible unwanted engagement of the flexible member 14 with the cover body 27. On the inside of drum body 26 is a spring loaded detent 12 which engageably locks into a recess 17 in the cover body 27 thereby also selectively preventing relative rotation between the cover means 3 and the drum means 1. This detent engagement or disengagement may be activated manually by access upon removal of cover plate 5. The drum flange 2 is normally integrally attached to the drum body 26 but may be separately formed. The drum flange 2 has formed therein a wedge shaped dovetail recess 19 which can engage a dovetail wedge shaped protrusion 24 on a mounting base 23 shown in FIGS. 3 and 4. Central to the recess 19 is threaded aperture 20 which can receive a mounting crank bolt 21 in the event one wishes to mount the reeling device on an alternate base **23*a* such as a portion of the body of a vehicle. Rough surfaces such as 22 ensure rigid mounting. To ensure winding up of the flexible member 14 upon relative rotation of the drum means 1 and cover means 3 there is a fastening means 16 holding one end of the flexible member 14 fast to the drum means 1 which includes any extension of the drum such as the flange 2 or the base support mounting 23**.

In the event that the reeling device is to be used in a fully extended position as a tow line on a vehicle the fastening means will take an alternate position **16*a* on vehicle body base 23*a* after passing through hand hole 28 of drum flange 2 as shown in FIG. 2 to avoid any stress on the reeling device "per se". The drum flange 2 may also have mounting holes 18. FIG. 2 is a bottom plan view of drum flange 2**.

Referring now to FIG. 3 there is shown a reeling device with drum means 1 having cover means 3 rotatably mounted thereon. The reeling device with recess 19 as shown in FIG. 1 receives protrusion 24 as shown in FIG. 4 thereby supporting the reeling device on a base support 23 with flexible member 14 having one end emerging from the hollow crank handle 6 and the other end releasably fastened to the base support 23 and thereby the drum by another type of alternate fastener **16*b*. The base support 23 is generally formed of an upright with a flat base to give stability. A carrying handle 25** can be added for portability.

Now referring to FIG. 4 there is shown the reverse side of the reeling device base support 23 as shown in FIG. 3. The reverse side has one or more wedge shaped protrusions to accept another reeling device which can be connected to the front one in series or to mount tools to be powered should the flexible member 14 shown in FIG. 3 be an electrical power cord.

Now referring to FIG. 5 there is shown in more detail the pivotably mounted crank handle 6 with tortuous slit 8 for entry of flexible member 14. The crank handle 6 is pivoted to cover body 27 on hinge means 31 and in the non operative pivoted position will lay outwardly from the cover body just below the plane thereof. In this position it is out of engagement with notch 30 and its tooth 32 engages teeth 33 of member 15 to prevent relative rotation between drum 26 and cover body 27.

Figure 6:
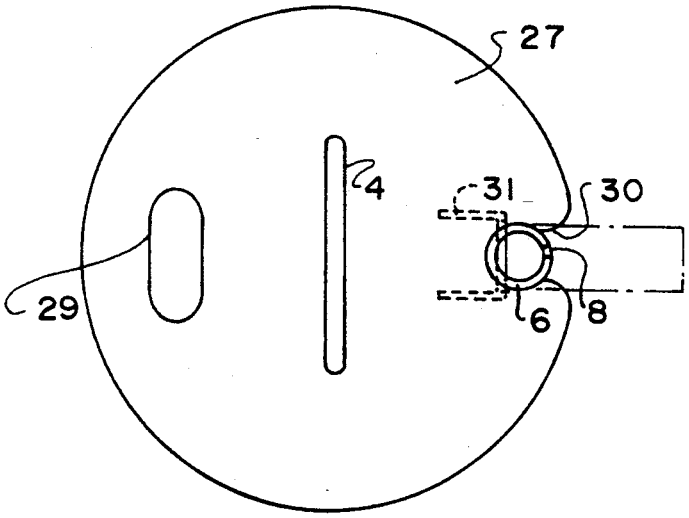
FIG. 6 is a top plan view of the cover body showing the friction snap lock holding the crank handle in operative position with the lockout position in phantom.

Referring to FIG. 6 there is shown in top plan the cover body 27 with hand hole 29 and crank handle 6 in upright position. Crank handle 6 in its upright position is held there by pivotably snapping it into lock notch 30 of cover body 27.

There is also envisaged a brush or sponge inserted in the free outer end of crank handle 6 to prevent dirt, snow or other extraneous material from entering the reeling device while reeling in the flexible member.

While "ABS" plastics has been considered as the best material of construction other material such as metal has also been considered.

OPERATION

The reeling device as detailed above has many uses and can be operated in many ways. The specific use is limited only by ones imagination. One of the preferred methods of operation is to deactivate the spring loaded detent 12 to enable relative rotation between the cover means and drum means. The crank handle 6 must also be in the upright position for relative rotation between the cover means and the drum means. In the event the flexible member wound on the drum body is an electrical extension cord the end fastened to the drum means or base support will have enough free cord to plug into a wall plug while the free end emerging from the hollow crank handle can be payed-out to a desired length and an appliance plugged in, the reverse is also envisaged. The spring loaded detent 12 may be reactivated for locking. However, because of the offset path from winding to emergence from the crank handle the spring loaded detent 12 is not normally required. When the cord is not required the crank handle 6 is used to rotate the cover means 3 thereby rewinding the cord on the drum means 1 for future use. Other similar uses such as a dog tether, clothes line, bicycle locking device and tow line are also envisaged. When used as a tow line for a vehicle, the reeling device may be mounted on the vehicle by a threaded crank bolt 21 passing through an element of the vehicle and threadably fastened to the drum means 1 which includes the flange. The spring loaded detent 12 is released, the flexible member such as a cord or cable is payed-out to its full extent and the flexible member end fastening means is relocated to be fastened to the vehicle at **16*a*** such that there will be a direct path from the vehicle through the hollow crank handle to a tension creating means. This prevents any unwanted stress on the reeling device "per se".

Although the invention has been described with a certain degree of particularity it is understood that the present disclosure has been made only by way of example and that numerous changes in the details of construction and the combination and arrangement of parts may be resorted to without departing from the spirit and scope of the invention as hereinafter claimed.

What I claim is:

1. A reeling device comprising in combination, a drum body having an inner surface and an outer surface to receive a flexible member, a drum flange attached to said drum body, a toothed circular plate retainer fixedly mounted on and adjacently encircling the outer surface of said drum body to cooperate with said drum flange for confining the flexible member on said drum body, a circumferential recess formed in the outer surface of said drum body, a cover body rotatably received in said circumferential recess, a hollow crank handle pivotally attached to said cover body to internally guide the flexible member to or from said drum body when said hollow crank handle is in an operative position perpendicular to said cover body, a tooth formed on said hollow crank handle to engage said fixedly mounted toothed circular plate retainer when said hollow crank handle is in an inoperative position, a drum flange recess, a mounting base, a protrusion on said mounting base to slideably engage said drum flange recess, a cover plate releasably attached to said cover body to permit access to the inner surface of said drum body, a spring loaded detent mounted on the inner surface of and passing through said drum body, a cover body recess to receive said spring loaded detent which has passed through said drum body to selectively prevent relative rotation between said cover body and said drum body, a fastener means to hold one end of the flexible member stationary relative to the movement of said cover body.

2. A reeling device as claimed in claim 1 wherein said mounting base is formed by a flat level portion and an upright portion carrying said protrusion.

3. A reeling device as claimed in claim 2 wherein said drum flange includes a threaded aperture to receive a threaded mounting means.

4. A reeling device comprising in combination, a drum body to receive a flexible member, a drum flange attached to said drum body and capable of assisting in confining the flexible member on said drum body, a cover body rotatably mounted on and adjacently encircling an outer circumference of said drum body, a toothed circular plate retainer fixedly mounted on and adjacently encircling an outer circumference of said drum body to assist in confining the flexible member of said drum body, a recess formed in the outer circumference of said drum body to rotatably receive said cover body, a hollow crank handle pivotally attached to said cover body to internally guide the flexible member to or from said drum body, said hollow crank handle including a tortuous path longitudinal slit to permit radial entry of the flexible member so that it may be internally guided, said hollow crank handle further including a tooth to engage said toothed circular plate retainer when said hollow crank handle is in an inoperative position, a fastener means to hold one end of the flexible member stationary relative to the movement of said cover body.

5. A reeling device as claimed in claim 4 further including a snap lock notch formed in said cover body and wherein said hollow crank handle is pivotally mounted on said cover body and releasably held in an operative position perpendicular to said cover body by said snap notch.

6. A reeling device comprising in combination, a tubular drum body, said tubular drum body including an external surface, a first portion of which is to receive a flexible member wound thereon, a drum flange having mounting means, said drum flange being attached to said tubular drum body so that said drum flange restricts axial movement of said flexible member when wound on said first portion of said external surface, a cover body rotatably mounted on and adjacently encircling a second portion of said external surface at a fixed axial location thereby forming with said drum flange an axial confinement for the flexible member wound on said first portion of said external surface of said tubular drum body, a recess receiving said cover body, formed on said tubular drum body defining said fixed axial location and wherein said tubular drum body external surface second portion forms at least a portion of said recess, a hollow crank handle attached to said cover body to receive a manual force for rotating said cover body, said hollow crank handle having an inner surface for internally guiding said flexible member to or from said tubular drum body, and a fastener means to hold one end of the flexible member stationary relative to the movement of said cover body.

7. A reeling device as claimed in claim 6 further including a snap lock notch in said cover body and wherein said hollow crank handle is pivotally mounted on said cover body and releasably held in operative position perpendicular to said cover body by said snap lock notch.

8. A reeling device as claimed in claim 7 wherein said hollow crank handle includes a tortuous path longitudinal slit to permit radial entry of the flexible member to said inner surface.

9. A reeling device as claimed in claim 8 further including a roller rotatably mounted near a proximal end of said hollow crank handle to assist in passage of the flexible member, and a resilient material substantially covering a distal end of said hollow crank handle to prevent ingress of foreign material usually found on the flexible member.

10. A reeling device as claimed in claim 8 wherein said tubular drum body further includes an inner circumference, a cover plate releasably attached to said cover body to permit entry to said inner circumference.

11. A reeling device as claimed in claim 10 further including a detent locking means mounted on said inner circumference and passing through said tubular drum body to releasably engage said rotatable cover body.

12. A reeling device as claimed in claim 6 wherein said recess further includes a retaining ring.

13. A reeling device as claimed in claim 6 wherein said recess is in the form of a groove.

14. A reeling device as claimed in claim 13 wherein an inner circumferential area of said cover body is sufficiently flexible to be forced over an end of said drum body and be received in said groove.

* * * * *